United States Patent [19]

Schweigert

[11] 4,042,141

[45] Aug. 16, 1977

[54] BUCKET ATTACHMENT FOR GARDEN TRACTORS

[76] Inventor: James R. Schweigert, 4696 Flag Ave. North, Minneapolis, Minn. 55428

[21] Appl. No.: 681,185

[22] Filed: Apr. 28, 1976

[51] Int. Cl.[2] ..... E02F 3/62

[52] U.S. Cl. ..... 214/766; 214/780

[58] Field of Search ..... 214/766, 780

[56] References Cited

U.S. PATENT DOCUMENTS

| | | | |
|---|---|---|---|
| 2,330,847 | 10/1943 | Seal | 214/766 |
| 2,760,284 | 8/1956 | Cook | 214/766 |
| 3,536,222 | 10/1970 | Patnode | 214/766 |
| 3,912,092 | 10/1975 | Bolton et al. | 214/766 |

FOREIGN PATENT DOCUMENTS

| | | | |
|---|---|---|---|
| 609,079 | 11/1960 | Canada | 214/766 |

*Primary Examiner*—Robert J. Spar
*Assistant Examiner*—Ross Weaver
*Attorney, Agent, or Firm*—Merchant, Gould, Smith, Edell, Welter & Schmidt

[57] ABSTRACT

An improved combination of compact tractor and scoop attachment, in which pivotal movement of the scoop in its frame in each direction is limited, and in one direction is retained by automatically operable, easily releasable means which is arranged to isolate the mechanism from forces transmitted through the scoop. As shown, the scoop frame is designed to receive numerous different coupling arrangements for various vehicle hitches.

5 Claims, 12 Drawing Figures

FIG. 12
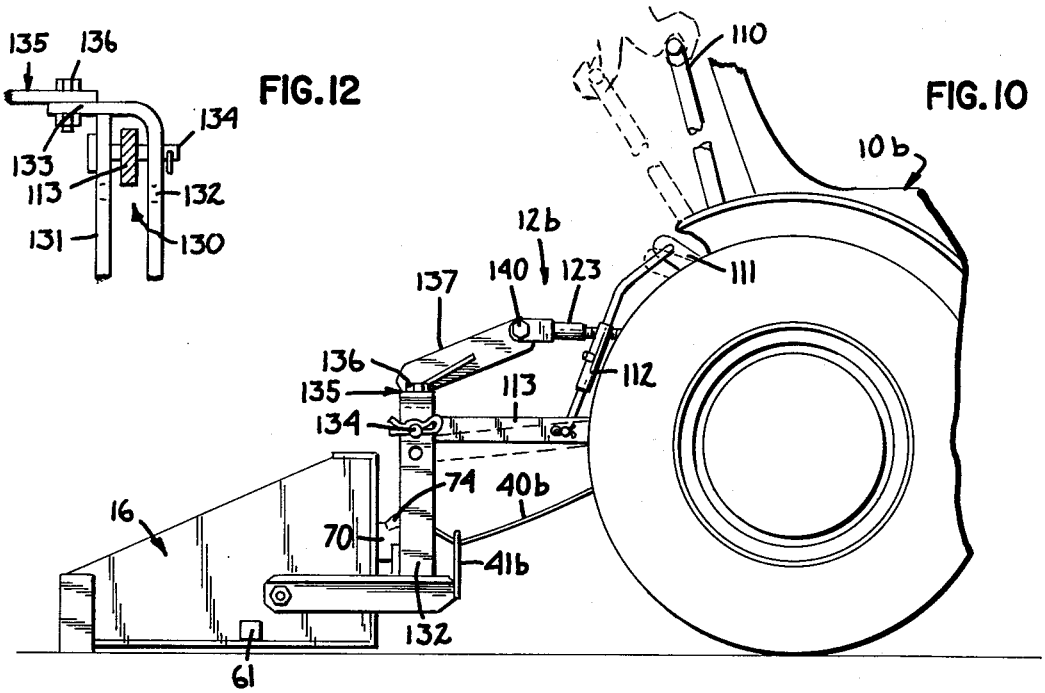
FIG. 10
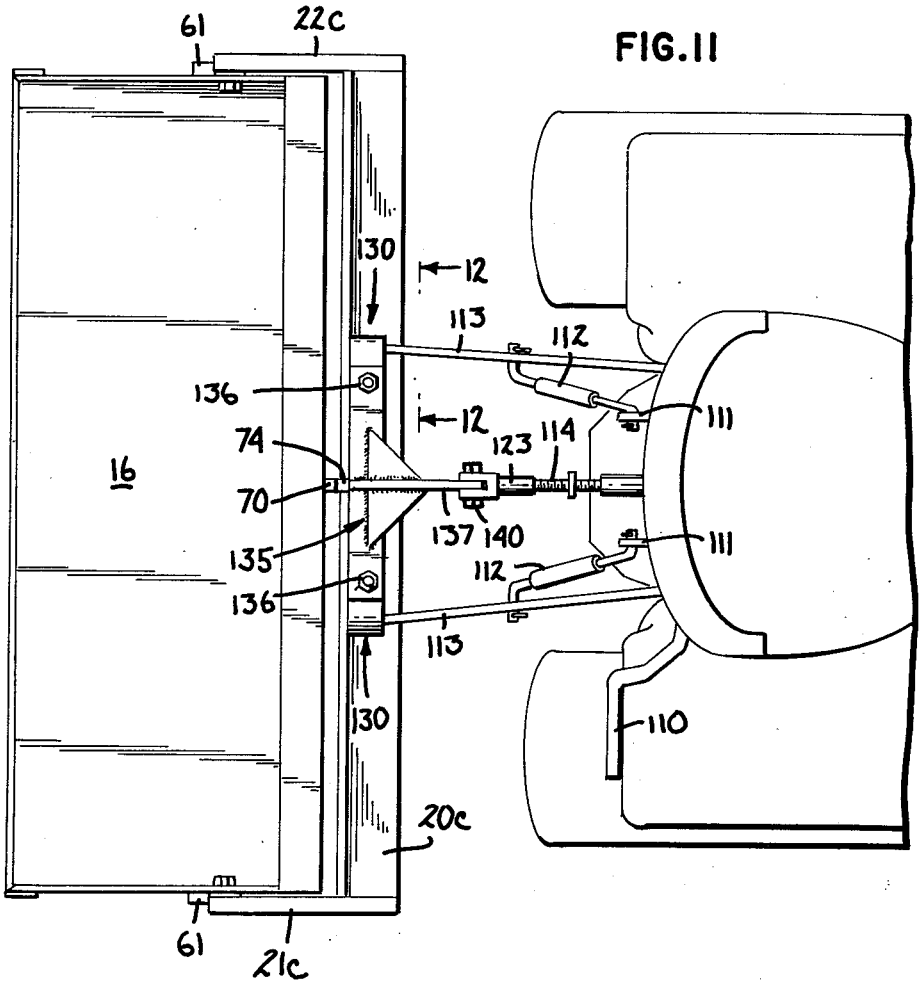
FIG. 11

BUCKET ATTACHMENT FOR GARDEN TRACTORS

BACKGROUND OF THE INVENTION

This invention relates to the field of compact tractors and attachments thereto, and specifically to a new structure in scoops for attachment to and operation by such tractors. It is known to provide a scoop pivotable above a horizontal axis in a frame projecting forwardly or rearwardly from a tractor and variable in height with relation to the ground surface by a hitch actuated hydraulically or otherwise and forming a part of or an attachment to the tractor. One such arrangement is taught in Patnode U.S. Pat. No. 3,536,222, and includes a pin-in-hole arrangement for maintaining the scoop in a desired pivotal relationship to the supporting frame, the pin being withdrawable to permit the loaded scoop to tip and so dump its load. The connection between the tractor hitch and the scoop frame in this patent is partly rigid but also partly by means of chains, which permit an undesirable amount of freedom of movement, and hence of wear, in the coupling, and of vibration in the scoop attachment itself. The pin-in-hole arrangement is quite primitive and subject to rapid wear, not only in its intended use, but whenever the back of the scoop moves slightly with respect to its mounting frame under the forces acting during use of the device, and its proper engagement must usually be assisted manually.

SUMMARY OF THE INVENTION

I have discovered that it is advantageous to be able to use the scoop in a position in the frame 90 degrees different from the normal position, and I have devised a new arresting arrangement for limiting the pivotal movement of the scoop in its frame at this 90° position for one extreme position of the scoop, and for automatically but releasably holding the scoop in a second extreme position. My arrangement is such that a latching blade engages a finger to prevent pivotal movement of the scoop, but is isolated from any adverse effect due to the yielding or bulging of the metal under the forces of loading and carrying.

My invention is easily adaptable for cooperation with any of the well-known coupling arrangements or "hitches" for connecting a tractor to an accessory implement.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWINGS

In the drawing.

FIGS. 10 and 11 are views similar to FIGS. 2 and 1 showing a still further embodiment of my invention; and FIG. 12 is a fragmentary sectional view taken along the lines 12—12 of FIG. 11, parts being omitted for clarity.

DESCRIPTION OF THE PREFERRED EMBODIMENTS

Figure 1:
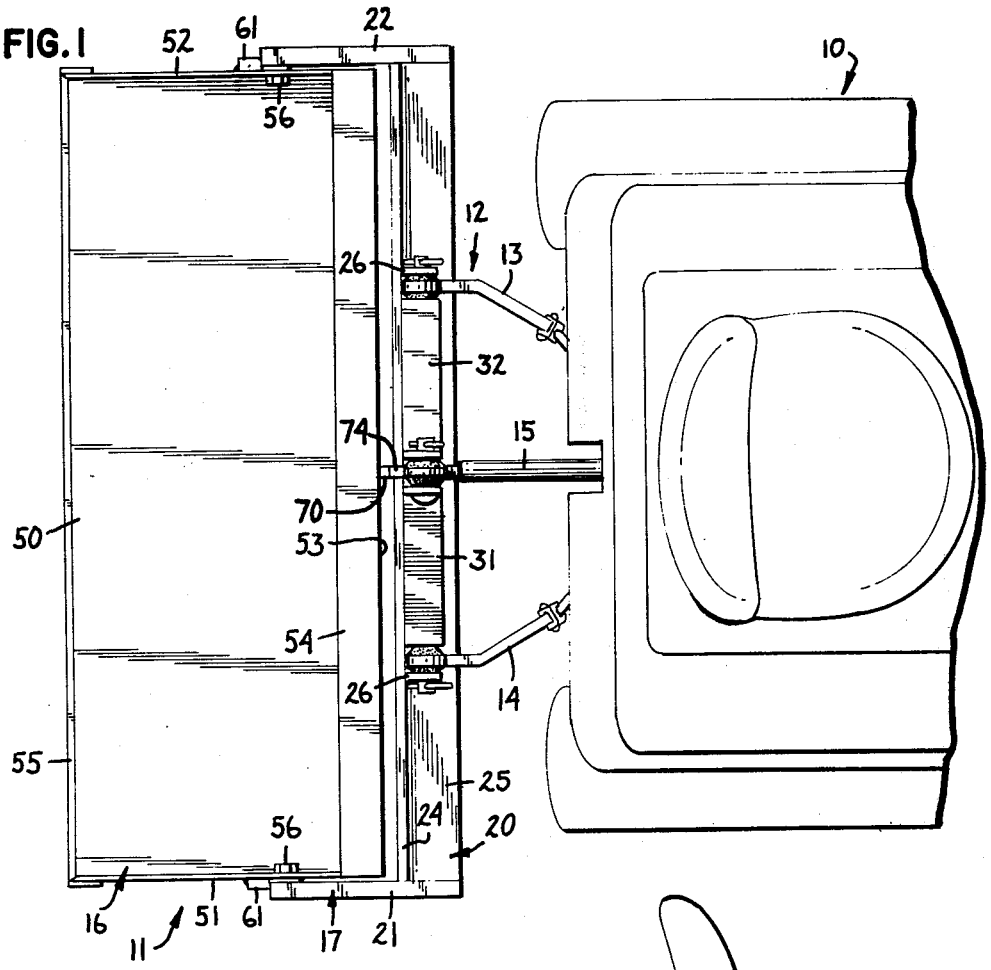
FIG. 1 is a plan view of one embodiment of my invention.
Figure 2:
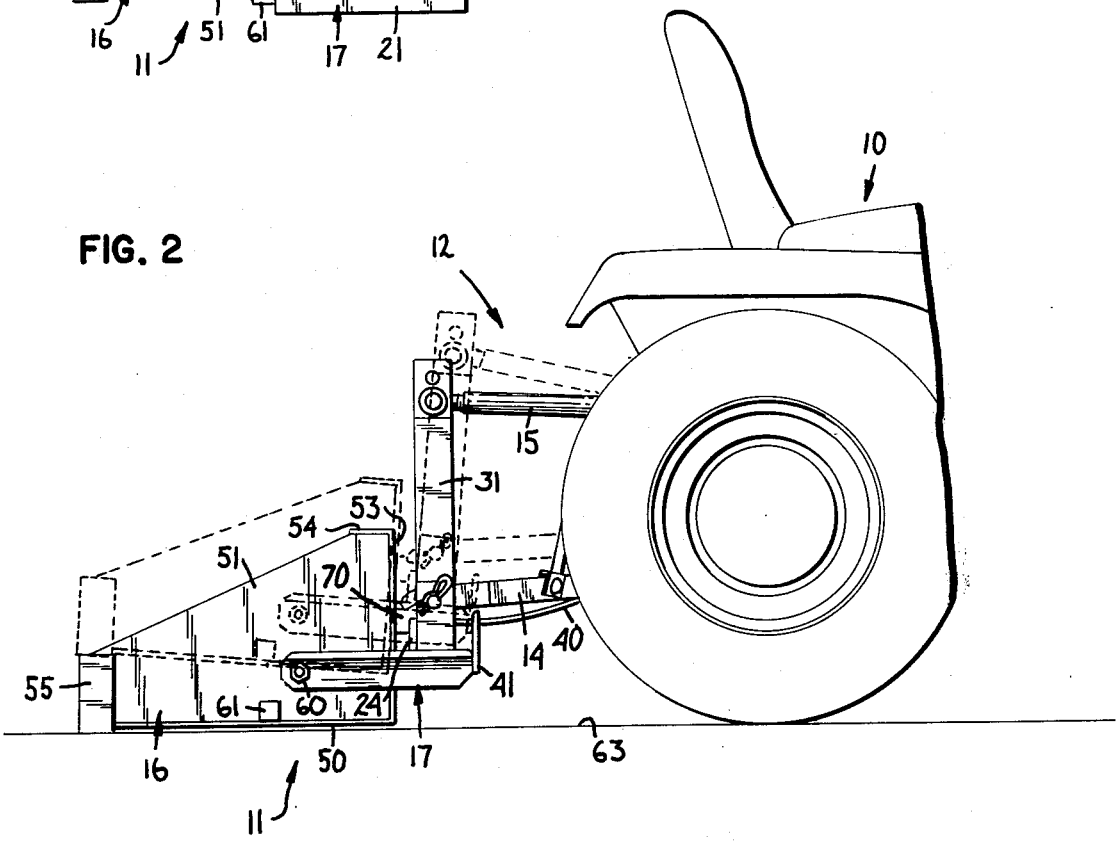
FIG. 2 is a side view of the structure of FIG. 1 in a first position, shown in solid lines, and a second position, shown in broken lines.

A compact tractor 10 is shown in FIGS. 1 and 2 to be connected to a scoop attachment 11 by a coupler 12 of a type commercially recognized as a Category "O" three-point hitch, which comprises a pair of lower arms 13 and 14 and an upper arm 15. Arms 13 and 14 are arranged for hydraulic operation between the solid line position and a second position indicated by the dotted line showing. Attachment 11 comprises a scoop 16 and a frame 17.

As shown in FIGS. 1–4, frame 17 comprises a main cross member 20 slightly longer than scoop 16, and having arms 21 and 22 extending in the same direction from its ends and bored coaxially. Member 20 may be a weldment or a Z-bar having a downward flange 23 and an upward flange 24. Secured to the top surface 25 of cross member 20 and the inner face of flange 24 are a pair of short rigid bars 26. Also secured to the surfaces of cross member 20 are a pair of rigid arms 31, 32 bent to jointly exhibit an inverted Y shape, reinforced by a gusset 33, and terminating in a pair of spaced ends 34, 35 bored as at 36 for connection with hitch arm 15. Arms 31, 32 and bars 26 are bored coaxially at 27 for connection with hitch arms 13 and 14.

Frame 17 also includes a latching member 37, which will be described more fully in connection with FIG. 7, and which is operated by an actuating line 40 passing through a hairpin guide 41.

Scoop 16 comprises a bottom 50, a pair of ends 51 and 52, and a back 53 which may be returned at 54 to act as a partial top for the scoop. The front edges of bottom 50 and ends 51 and 52 may be reinforced by a suitable member 55.

Ends 51, 52 are bored to pass a pair of pivot bolts 56, by which the scoop is pivoted in the coaxial bores in arms 21 and 22 using nuts 60.

Figure 3:
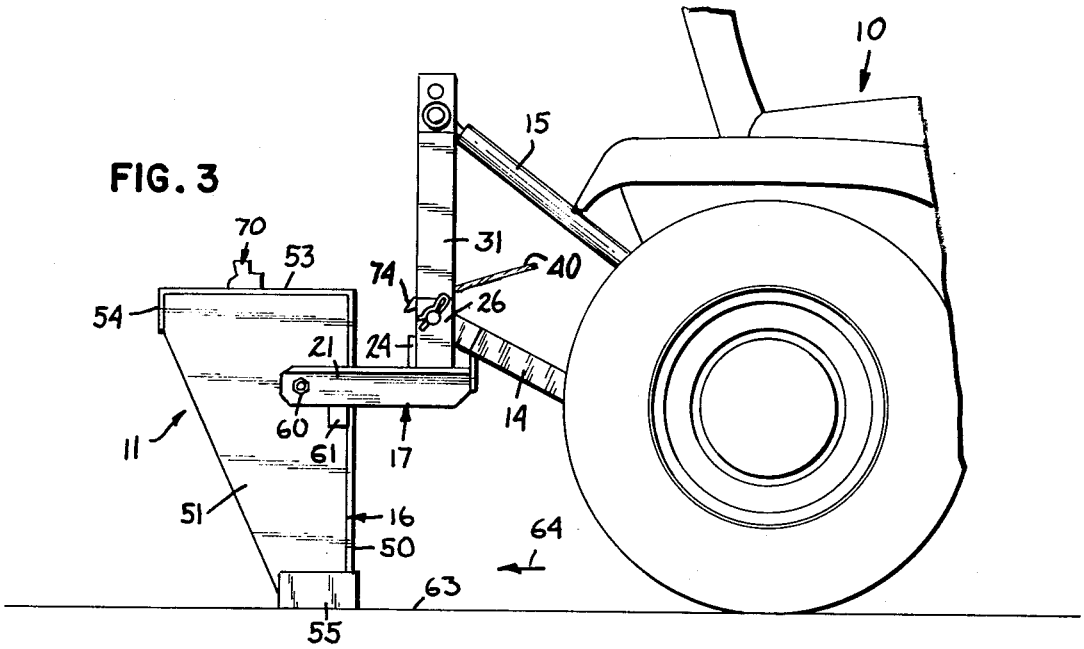
FIG. 3 is a view like FIG. 2, showing the arrangement in a third position.
Figure 4:
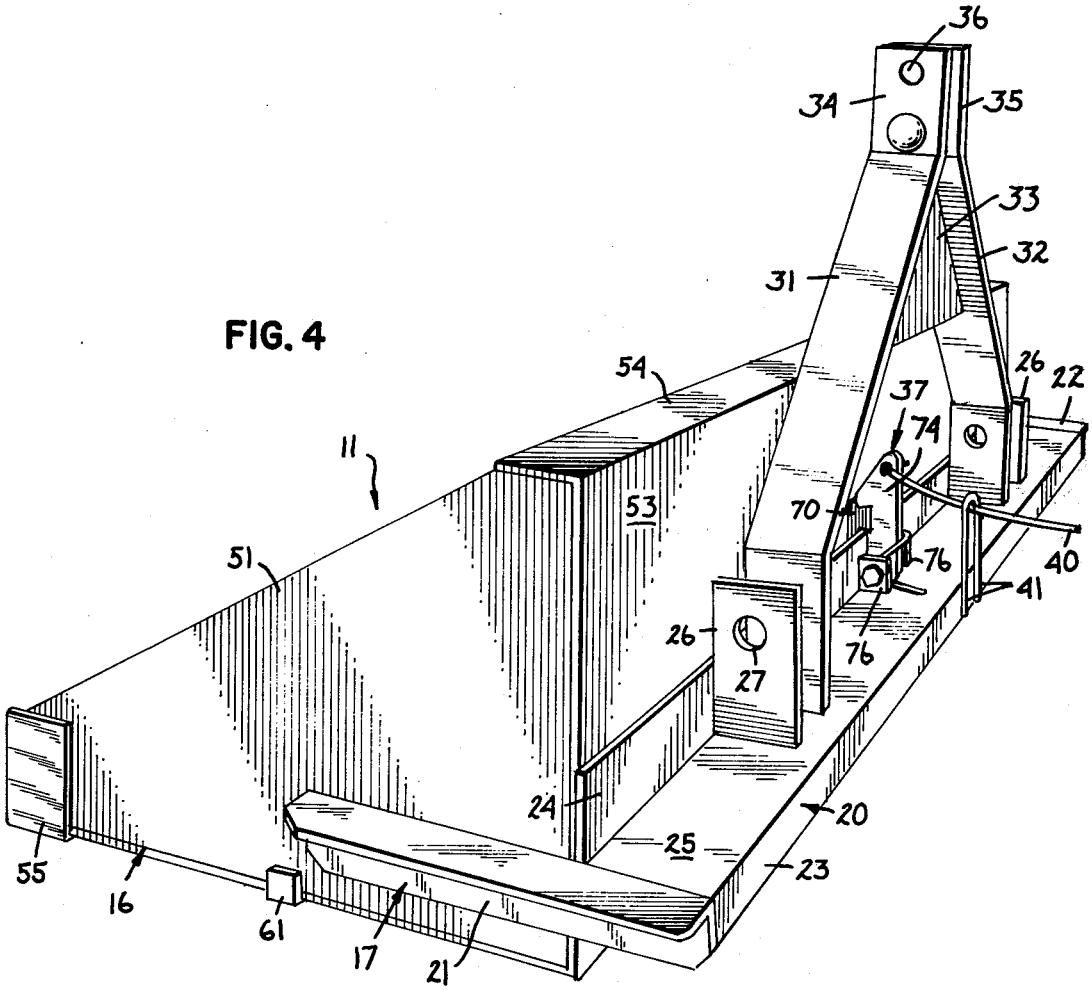
FIG. 4 is a perspective view of the scoop attachment of FIG. 1 to a larger scale.

A pair of fixed stop means 61 are provided in the form of blocks secured to the outer surfaces of ends 51 and 52 at their bottoms and near their centers: these blocks extend from the ends by more than the distances between the ends and arms 21 and 22, respectively. As shown in FIG. 3, these stop means engage the under edges of the arms of frame 17 when scoop 16 is positioned to a point where the bottom 50 is vertical. This prevents further pivotal movement of the scoop by reason of contact with the ground 63 when the vehicle moves in the direction indicated by arrow 64.

Figure 7:
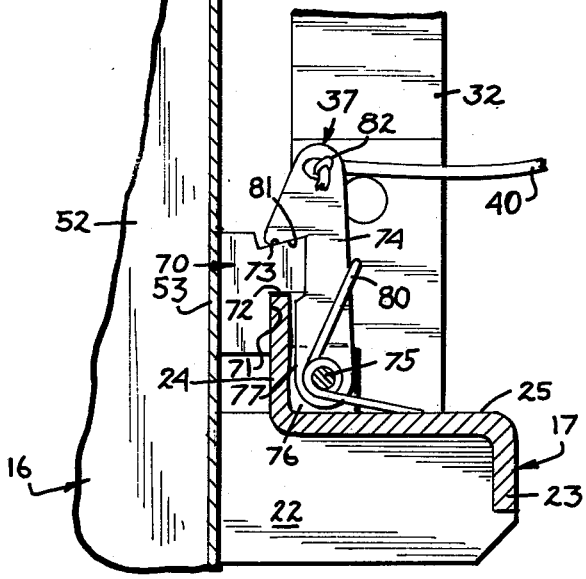
FIG. 7 is a detailed showing of a latch and related elements making up part of my invention.

A stop finger 70 is secured to the outer surface of back 53, as best shown in FIG. 7. Finger 70 has a vertical stop face 71, a horizontal stop face 72, and a latching face 73. It is positioned on back 53 so that when scoop 16 is in the pivoted position shown in FIG. 2, surfaces 71 and 72 engage the face and top of flange 24, thus transferring thereto forces acting on back 53 due to use of the scoop.

Latching member 37 comprises a blade 74 pivoted on a bolt 75 extending between two mountings 76 carried on cross member 20. One edge 77 of blade 74 is urged toward engagement with flange 24 by a torsion spring 80, and this edge of the blade is provided with a notch 81 to engage surface 73 of finger 70. While ideally the surface of engagement between notch 81 and surface 73 should be a portion of circular cylinder axial about bolt 75, in practice it is found that a plane tangent to such a surface is sufficiently accurate for practical purposes. Line 40 is connected to blade 74 at 82.

Figure 5:
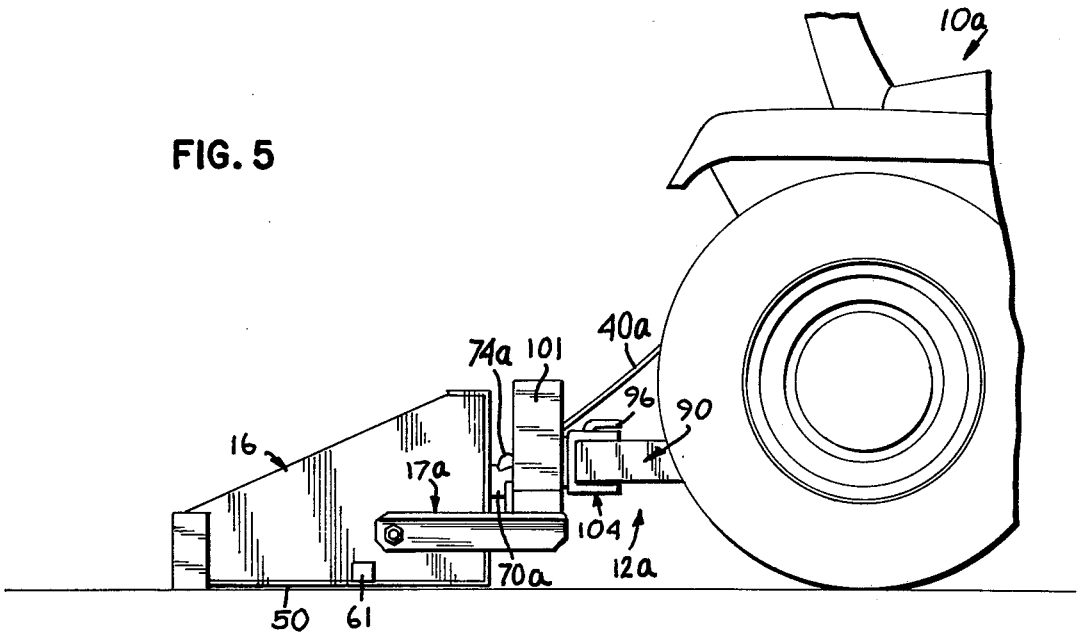
FIG. 5 is a view similar to FIG. 2 showing a second embodiment of my invention.
Figure 6:
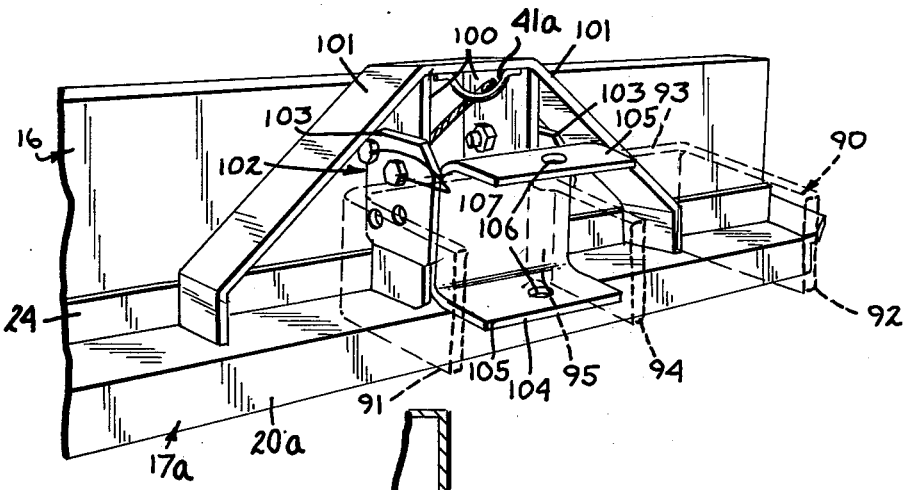
FIG. 6 is a fragmentary perspective view, generally similar to FIG. 4, of the second embodiment.

My invention is equally useful when the scoop is to be used with tractors having the "sleeve" or "one point" type coupling hitch, as is shown in FIGS. 5 and 6.

For this use the scoop and its connections to and relation with the frame remain unchanged, but the frame itself is modified to accord with the hitch of the tractor. In FIG. 5, scoop 16 is shown as mounted in a frame 17a connected to the tractor 10a by a hitch 12*a*. Hitch 12*a* comprises a rigid structure 90 of metal including a pair of arms 91, 92 connected at first ends by a cross arm 93, and pivoted to the tractor at their other ends. A further stub arm 94 projects from the cross arm toward the tractor for connection to a lifting arm, not shown, to pivot the entire hitch about the pivots of arms 91, 92. The junction 95 between stub arm 94 and cross arm 93 is enlarged, reinforced, and bored to receive a linch pin 96.

Cross member 20a includes end arms as before for pivotally supporting the scoop, and for cooperating with stop means 61, and also includes latching member 37 for coacting with finger 70 on the scoop, and actuated by line 40a. A pair of metal plates 100 are secured to cross member 20*a*, as by welding, and are connected at the tops and braced at the sides by a reinforcing member 101 also secured to cross member 20*a*. An adjustment member 102 is shown to comprise a pair of side plates 103 welded to the base of a U-shaped member 104. The legs 105 of member 104 are spaced to receive member 90, and are bored at 106 to pass linch pin 96. Plates 100 are provided with pairs of holes, and plates 103 are provided with a plurality of pairs of holes, so that adjustment means 102 may be connected to plates 100 in any of a plurality of positions by use of bolts 107. In this form of coupling, a line guide 41a is also provided.

Figure 8:
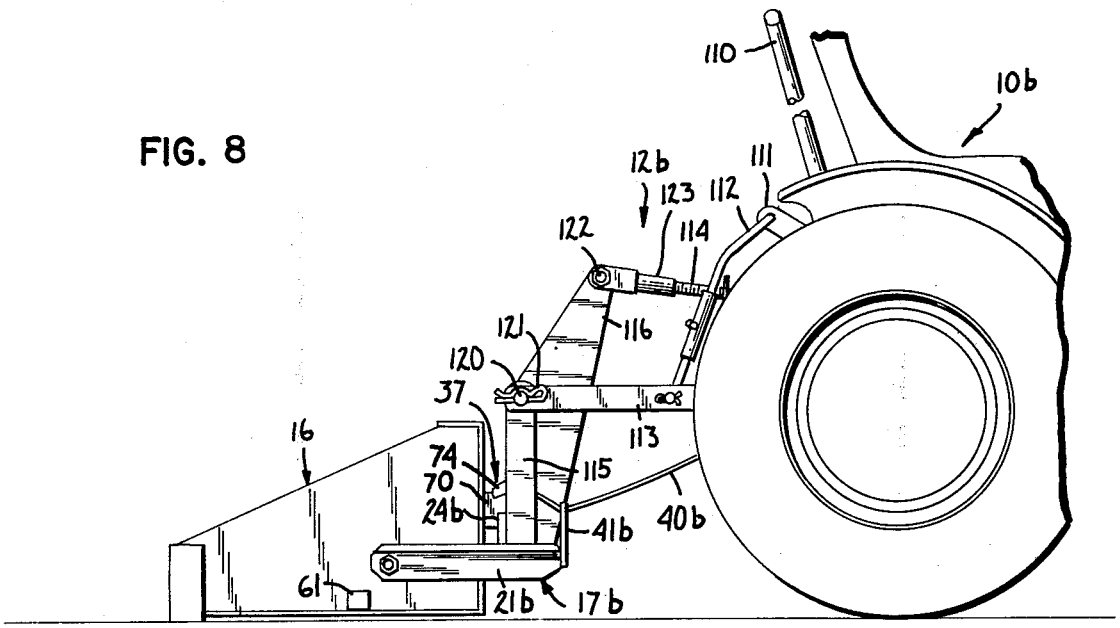
FIGS. 8 and 9 are views similar to FIGS. 2 and 1, respectively, showing a further embodiment of my invention.
Figure 9:
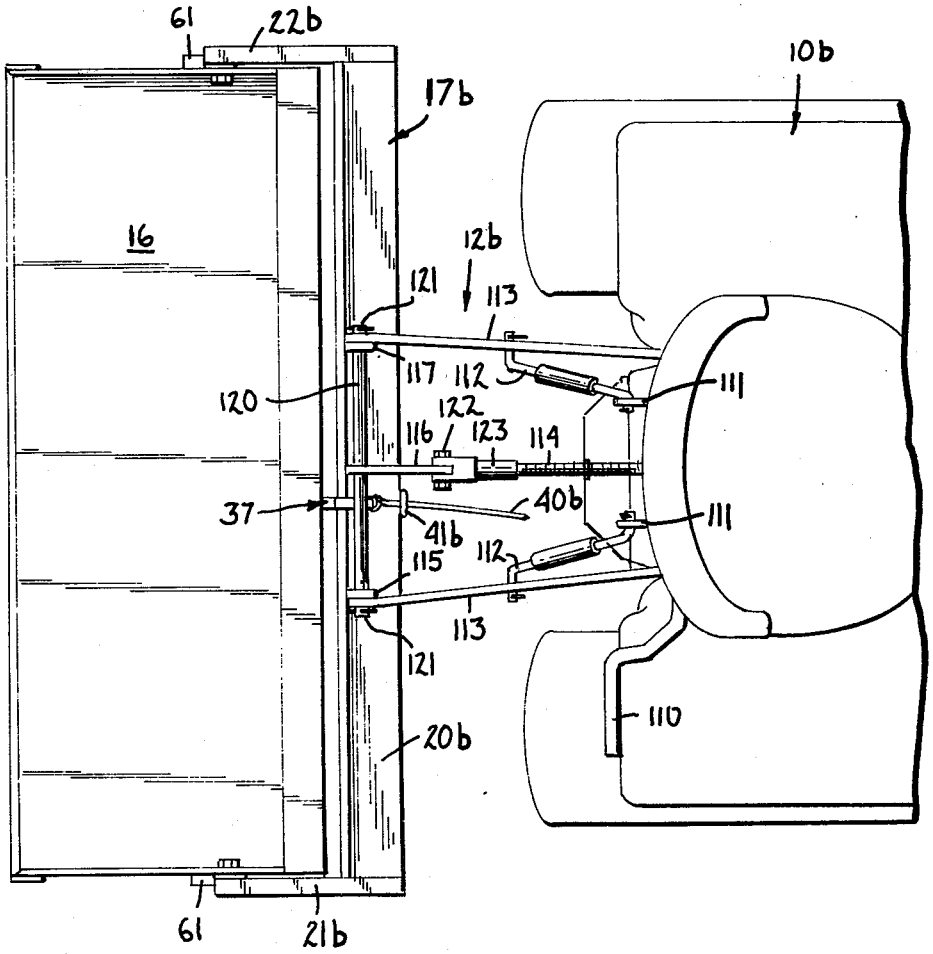

FIGS. 8 and 9 show my invention adapted for use with a still further tractor hitch in which lifting is manual rather than mechanical. A tractor 10b is provided with a hitch 12b wherein a manual lever 110 acts through a pair of levers 111 and turnbuckle arms 112 on a pair of lifting arms 113 loosely pivoted at first ends to the frame of the tractor. A further arm 114 of adjustable length is also pivoted at one end to the tractor frame. Scoop 16 and its relation with the frame 17b remain unchanged, but the frame itself is modified to accord with hitch 12*b*. In frame 17*b*, members 20*b*, 21*b* and 22*b* are as before. A plurality of vertical members 115, 116 and 117 are welded to frame member 20*b* and flange 24*b* at their lower ends, and to a cross member 120 configured at its ends to receive arms 113, which are retained by hairpins 121. Member 116 pivotally receives arm 114 at a bolt 122. A clevis 123 at the end of arm 114 enables longitudinal leveling of frame 17*b*. Latch member 37 is the same in this embodiment of the invention.

FIGS. 10 and 11 show my invention adapted for use with the hitch of FIGS. 8 and 9 in a way which has special advantages. In this embodiment, a pair of spaced structures 130 are secured to cross member 20*c* as by welding. Each structure comprises a first vertical bar 131 and a second vertical bar 132 having its top end 133 bent over and secured to the top of bar 131. Near their top bars 131 and 132 are bored coaxially at two places to pass a connection pin 134 for engagement with one of lifting arms 113. A cross bar 135 is secured to the bent ends of bars 132 by fasteners 136. An arm 137 is welded to project upwardly from the center of bar 135, and is connected to clevis 123 of arm 114 by a fastener 140. In other aspects, the structure is as in FIGS. 8 and 9.

Operation

In operation, the scoop attachment is connected to the tractor by whichever hitch is provided therefor: if that of FIGS. 5 and 6 is used, an initial selection of bolt holes in plates 103 may be made to give the most favorable orientation of the scoop in the "down" position of the hitch. Scoop 16 is held in the position shown in solid lines in FIG. 2 by finger 70 and blade 74. The operator drives the tractor so that the scoop enters a pile of snow, dirt, or other material to be moved, and becomes filled with the material. Operation of the hitch now lifts the scoop - see the broken line position of FIG. 2 - and the material is transported to its desired new location. A pull on line 40 withdraws latching blade 74 from finger 70, allowing the scoop to dump its load. The hitch is lowered to pivot the scoop back to its initial position, whereupon latching blade 74 re-engages finger 70 so that another load of material may be picked up. It is to be particularly noted that any forces exerted by the loading procedure on the back of the scoop are not transmitted to latching blade 74, but are taken directly by flange 24 through surfaces 71 and 72 of finger 70.

If it is desired to perform a scraping operation, the scoop is not restored to its normal position, but it is positioned as shown in FIG. 3 so that the edges of bottom 50 and member 55 are in contact with the ground and the bottom of the scoop extends vertically. Now as the vehicle moves in the direction of the arrow in FIG. 3, pivotal movement of scoop 16 is prevented by stop means 61, and a satisfactory scraping operation results.

The advantage inherent in the improved modification of FIGS. 10–12 will now be described, referring particularly to FIG. 10. When arms 113 are connected to the upper holes in structures 130, handle 110 is positioned as shown in solid lines relative to the tractor operator, so that he can more conveniently apply the strength of his arm to actuate the handle in a pushing action supported by his body. It has been found that a load of 150 pounds can readily be lifted by the average operator from his normal position on the tractor seat in this mode of use of the device. There, is, however, the disadvantage that the scoop cannot be lifted so far above the ground: where greater ground clearance is necessary the pins 135 should pass through the lower holes in structures 130 to provide maximum scoop travel from available handle travel. This is shown in broken lines in FIG. 10, and it will be apparent that the position of handle 110 is now so far back as to require less efficient application of the operator's strength to the operation in a sort of backhanded pulling action. For this mode of operation, it has been found that the operator's capability of ready lifting from his normal position in the tractor seat is in the neighborhood of only 100 pounds.

From the foregoing, it will be seen that I have invented an improvement in compact tractors with scraper attachments. My invention is adapted for use with tractors having any of the common hitches. It provides a pivoted scoop with limits to its pivotal movement in each direction, one of the limiting means including a readily releasable, automatically operable latching arrangement especially arranged for isolation from linear forces transmitted by the scoop during operation.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A scoop attachment, adapted to be connected to the lifting hitch of a power vehicle, comprising, in combination:

a scoop for loading, lifting, transporting, and dumping materials, having a closed back, closed ends, and a stop finger secured to the outer surface of said back between said ends, said finger including lower and rear stop faces and an upper latching face;

a frame, including a cross member, rigid means projecting from said cross member in a first direction and including coupling means for receiving the hitch of the vehicle, and a pair of arms projecting from said cross member in a second direction toward said scoop;

means movably connecting the ends of said scoop to said arms for pivotal movement therebetween;

means rigid with said cross member and positioned to engage said stop faces of said stop finger in a predetermined pivoted position of said finger and said scoop in said frame, to limit said pivotal movement in a first sense and to prevent translational movement of said finger in a direction towards said frame;

a latching blade resiliently pivoted to said frame for automatically and releasably engaging said latching surface of said stop finger in said predetermined position thereof, to prevent said pivotal movement in a second sense opposite to said first sense;

and manually operable means for pivotally releasing said latching blade from engagement wit said finger, to thereby enable pivotal movement of said scoop in said second sense.

2. The structure of claim 1, for use with a threepoint hitch having lower arms and an upper arm, in which the coupling means includes a pair of separate rigid members joined in an inverted Y-formation to receive the lower arms of said three-point hitch, near the base of the formation, and the upper arm of the hitch, near the apex of the formation.

3. The structure of claim 1 in which the coupling means includes a U-shaped member, means securing said member to said rigid means with the legs of said member vertically spaced and horizontally extending to receive a "one-point" vehicle hitch, and a pair of aligned apertures in said legs for passing the linch pin of said hitch.

4. The structure of claim 1 in which the coupling means is for connection to a manual lift vehicle hitch having lower arms and an upper arm, and includes laterally spaced central and outer rigid members, said central member extending vertically further than said outer members, means interconnecting the upper ends of said outer members to said central member and arranged for connection to the lower arms of a manual lift vehicle hitch, and means connecting the upper end of said central member to an upper arm of the hitch.

5. The structure of claim 1 in which said rigid means comprises two pairs of members, each pair including a short member and a long member inwardly spaced therefrom with aligned mounting holes in said members for engagement with the lower arms of a three-point hitch, said long members being upwardly convergent to the location of a further pair of aligned mounting holes for connecting said members to the upper arm of the hitch.

* * * * *